US008702345B2

(12) United States Patent
Stein

(10) Patent No.: US 8,702,345 B2
(45) Date of Patent: Apr. 22, 2014

(54) MODULAR, DYNAMICALLY SIZED AND SHAPED, INDUSTRIAL-LIQUID-CONTAINMENT SYSTEM AND METHODS OF USE

(76) Inventor: Allen Leroy Stein, Clifton, CO (US)

( * ) Notice: Subject to any disclaimer, the term of this patent is extended or adjusted under 35 U.S.C. 154(b) by 0 days.

(21) Appl. No.: 13/820,476

(22) PCT Filed: Sep. 8, 2011

(86) PCT No.: PCT/US2011/050834

§ 371 (c)(1),
(2), (4) Date: Mar. 1, 2013

(87) PCT Pub. No.: WO2012/033917

PCT Pub. Date: Mar. 15, 2012

(65) Prior Publication Data

US 2013/0164082 A1 Jun. 27, 2013

Related U.S. Application Data

(60) Provisional application No. 61/381,168, filed on Sep. 9, 2010.

(51) Int. Cl.
*E02B 7/08* (2006.01)

(52) U.S. Cl.
USPC ..... 405/114; 405/52; 405/107; 52/102

(58) Field of Classification Search
USPC ..... 405/52, 107, 114, 129.45, 129.6, 405/129.75, 129.8, 129.9; 220/9.4, 9.1, 9.2, 220/4.03, 4.12, 4.16, 4.17, 692, 693; 52/102, 169.7; 404/7, 8
See application file for complete search history.

(56) References Cited

U.S. PATENT DOCUMENTS

| | | | |
|---|---|---|---|
| 3,500,602 | A | 3/1970 | Ueno |
| 3,629,985 | A | 12/1971 | Ueno |
| 3,736,754 | A | 6/1973 | Azalbert et al. |
| 3,797,049 | A | 3/1974 | De Santo |
| 3,835,605 | A | 9/1974 | Ueno |
| 3,943,721 | A | 3/1976 | Azalbert et al. |
| 3,971,075 | A | 7/1976 | Heinbaugh et al. |
| 4,041,722 | A | 8/1977 | Terlesky et al. |
| 4,136,995 | A | 1/1979 | Fish |
| 4,473,978 | A | 10/1984 | Wood |
| 4,786,205 | A | 11/1988 | Hisken et al. |

(Continued)

FOREIGN PATENT DOCUMENTS

| | | | |
|---|---|---|---|
| WO | WO-9410498 | A1 | 5/1994 |
| WO | WO-2011056067 | A2 | 5/2011 |

*Primary Examiner* — Sean Andrish
(74) *Attorney, Agent, or Firm* — Leyendecker & Lemire, LLC

(57) ABSTRACT

A portable, modular, and dynamically sized and shaped, above-ground, industrial-liquid-containment system is disclosed. In an exemplary embodiment, the system includes a plurality of elongated curbs, each of which has a substantially inverted-V-shaped cross-section. In variations, each curb can have a flat top surface, from which two walls extend downwardly at a predetermined angle. At the bottom of each of the curb walls, is a foot surface extending substantially parallel to the ground and to the flat top surface. The plurality of curbs are detachably coupled together to define a perimeter for a liquid-containment area. The height of the curbed boundary can be increased by installing curb-height extender members onto the first-layer of curb members. The defined containment-area floor and the plurality of curbs is continuously covered by liquid-impermeable sheeting in order to prevent leakage into the outer-ground environment.

61 Claims, 10 Drawing Sheets

(56) References Cited

U.S. PATENT DOCUMENTS

| | | | | | |
|---|---|---|---|---|---|
| 4,932,085 | A | | 6/1990 | Saj | |
| 4,976,063 | A | | 12/1990 | Young | |
| 5,108,225 | A | | 4/1992 | Neal | |
| D334,238 | S | | 3/1993 | Spedini | |
| 5,246,308 | A | | 9/1993 | Brothers | |
| 5,401,118 | A | * | 3/1995 | Kramer | 405/129.9 |
| 5,454,195 | A | | 10/1995 | Hallsten | |
| 5,489,165 | A | | 2/1996 | Smith | |
| 5,547,312 | A | | 8/1996 | Schmitz, Jr. | |
| 5,605,416 | A | | 2/1997 | Roach | |
| 5,743,674 | A | | 4/1998 | Healy | |
| 5,791,099 | A | | 8/1998 | Duffy | |
| 5,924,461 | A | | 7/1999 | Shaw et al. | |
| 5,948,250 | A | | 9/1999 | Middleton | |
| 6,079,904 | A | | 6/2000 | Trisl | |
| 6,132,140 | A | | 10/2000 | Kullberg | |
| 6,270,286 | B1 | | 8/2001 | Solis | |
| 6,604,250 | B1 | | 8/2003 | Lee | |
| 6,606,836 | B2 | | 8/2003 | Miller | |
| 6,626,609 | B1 | | 9/2003 | Kotani et al. | |
| 6,676,333 | B2 | | 1/2004 | Wiseman et al. | |
| 6,679,654 | B1 | | 1/2004 | Wittenberg et al. | |
| 6,840,711 | B1 | | 1/2005 | Martinez et al. | |
| 6,935,809 | B2 | | 8/2005 | Svensson | |
| 7,574,834 | B2 | | 8/2009 | Murray | |
| 7,614,826 | B2 | * | 11/2009 | Vriens | 405/107 |
| 7,784,227 | B2 | | 8/2010 | Ribeiro | |
| 2004/0216373 | A1 | | 11/2004 | Kindley | |
| 2005/0086732 | A1 | | 4/2005 | Spicer | |
| 2008/0152431 | A1 | | 6/2008 | Ramp | |
| 2008/0253838 | A1 | | 10/2008 | Salemie | |
| 2009/0041543 | A1 | * | 2/2009 | Kroger | 405/114 |
| 2009/0103981 | A1 | | 4/2009 | Tagini | |
| 2010/0170749 | A1 | | 7/2010 | Leung | |

* cited by examiner

MODULAR, DYNAMICALLY SIZED AND SHAPED, INDUSTRIAL-LIQUID-CONTAINMENT SYSTEM AND METHODS OF USE

CROSS-REFERENCE TO RELATED APPLICATIONS

The present patent application claims the benefit of U.S. Patent Application No. 61/381,168, filed on Sep. 9, 2010, for "Liquid Containment System", and hereby incorporates by reference U.S. Patent Application No. 61/381,168 in its entirety for all purposes.

BACKGROUND

Liquid-containment systems are required in myriad industrial settings, particularly when there is a significant potential for the inadvertent and uncontrolled release of industrial waste to the environment. Over the past twenty years, the energy industry has used an average of 55 million cubic meters of water every year for a process known as hydraulic fracturing. By today's standards, this average would be a low estimate and the volume of water needed by the industry is widely expected to grow. The systems currently in place to store these large volumes of water, such as Frac Tanks and in-ground pits, are needlessly expensive, time consuming to erect, unreliable and dangerous, and inefficient.

In the oil and gas industry, there are two widely-used water storage systems:

1. A series of fracturing tanks (commonly known as "frac tanks")
2. An excavated pit (commonly known as an "earth pit")

Fracturing Tanks:

A typical frac tank is 45' long, 8.5° wide, and 10' tall with an average capacity of 500 bbl. Each tank must be individually permitted for use in the oil field and individually hauled to location. In addition, each tank must carry current state registration for transport.

Typically, many dozens of frac tanks will be brought to a single location so that enough water can be stored on site to carry out the fracture. A typical fracturing procedure will use anywhere from 55 to 80 bbl per minute and can last anywhere from twenty minutes to several hours. Some fracturing operations last for several days. But because the water leaves the tank through a 4" dia. hose, only about 8 bbl per minute can be pulled from a single tank. As a result, several tanks must be open at once and a complex and time-sensitive process of measuring the volume of water in each tank, then running down the stairs to open and close valves must be used to ensure a steady rate of flow. Mistakes are often made and the entire fracturing procedure frequently stops. In addition, because each tank has to be filled individually, they are often overfilled. Large frac-water puddles can be found at almost every location where frac tanks are used, not only as a result of overfilling, but also from the leakage that occurs every time one of the tank hoses are disconnected and drained onto the ground. Thus, significant EPA fines represent another risk to operators.

Earth Pits:

Earth pits are excavated and lined with an impervious membrane that prevents frac-water from seeping into the ground. Water is typically sucked out with a series of 4-inch hoses. In addition, earth pits are generally expensive to create. The cost of lease roads, location building, pit excavation, pit lining, and best-management practices (BMPs) to finish the location in accordance with federal and state requirements are formidable. Moreover, permitting for earth pits is also an expensive and time-consuming process as is the reclamation process upon completion. Therefore, due to a variety of environmental hazards, these kinds of open, in-ground pits are against code and can no longer be constructed in a growing number of regions across the US. It would be advantageous to be able to construct a pit without the problems and costs associated with excavation and site restoration.

BRIEF DESCRIPTION OF THE DRAWINGS

FIG. 5A depicts a top-view of the overall construction of an embodiment of the corner. FIGS. 5B-5D depict the top, side, and end views of an embodiment of a modified curb member (corner curb member) used in conjunction with a mirrored matching corner curb member to form a corner in the perimeter boundary of an industrial-liquid-containment system. FIG. 5E depicts a top view of an embodiment of a ballast member used to anchor a pair of corner curb members.

FIG. 6A depicts a side-view of a modified curb member with a modified curb-height extender member attached on top of the curb member. FIG. 6B depicts and end view of the same two members.

DETAILED DESCRIPTION

Overview

Figure 1A:
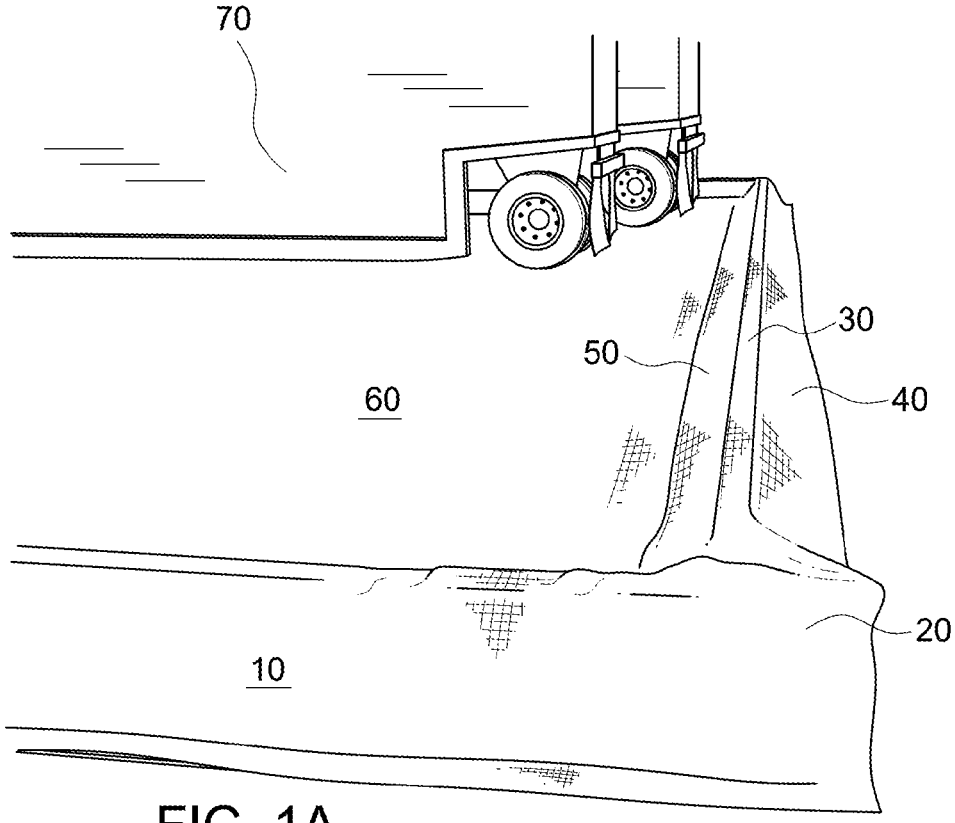
FIGS. 1A-1D depict one embodiment of a single-curb layer liquid-containment system used to protect against spills and leakage of industrial liquids from vessels disposed within the erected perimeter boundary of the containment system.
Figure 1B:
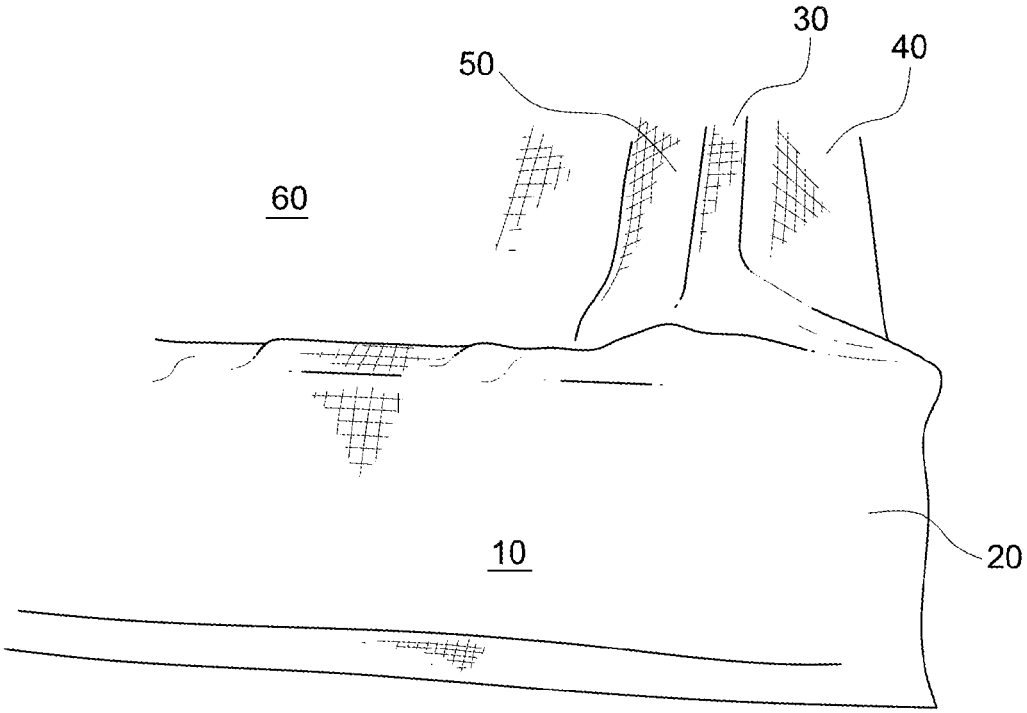
Figure 1C:
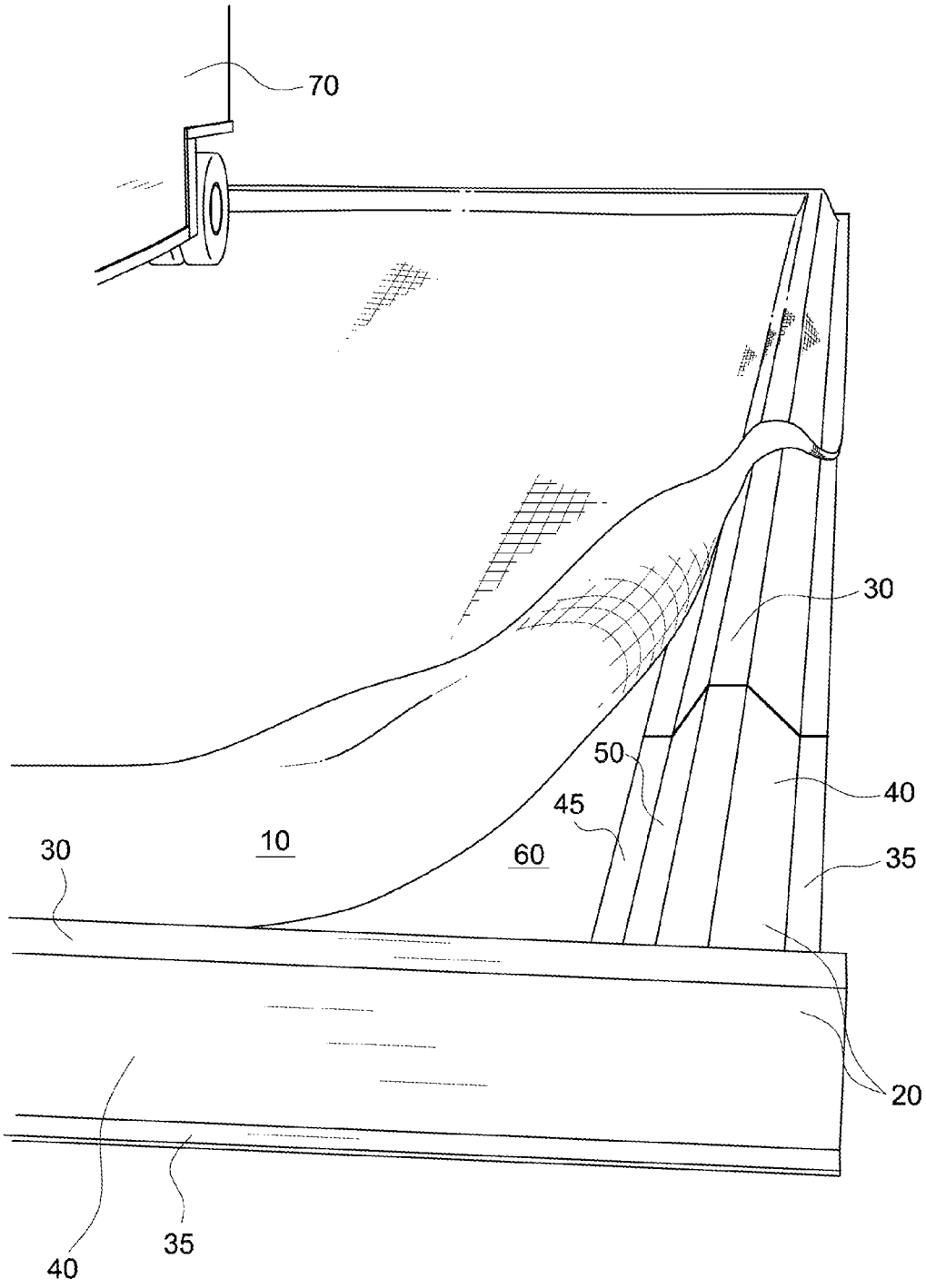
Figure 1D:
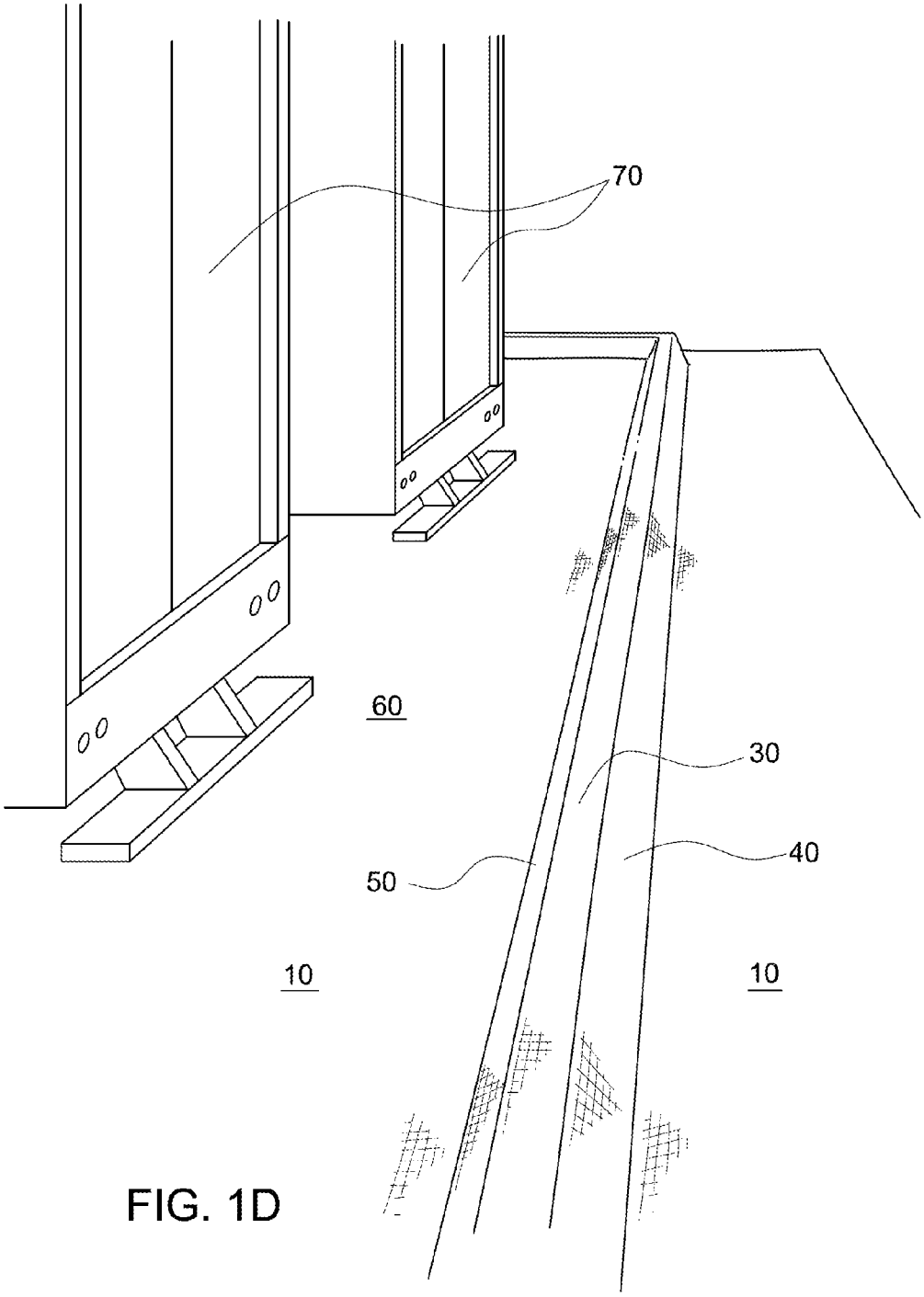
Figure 2A:
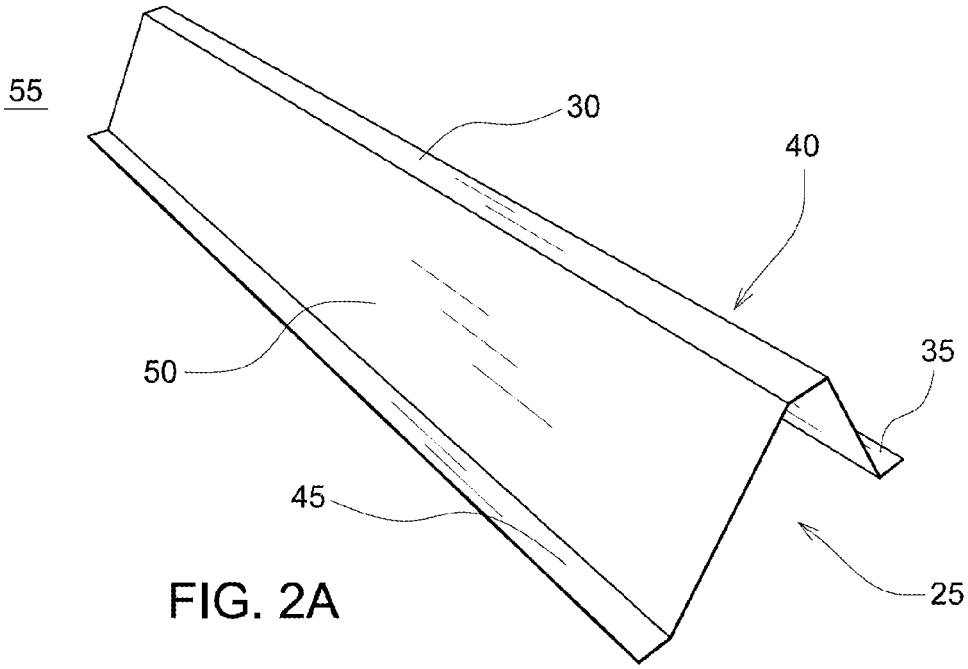
FIGS. 2A-2B depict one embodiment of an elongated, substantially rigid, curb member that is used as a component for defining a perimeter boundary when erecting a modular, dynamically shaped and sized industrial-liquid-containment system.
Figure 2B:
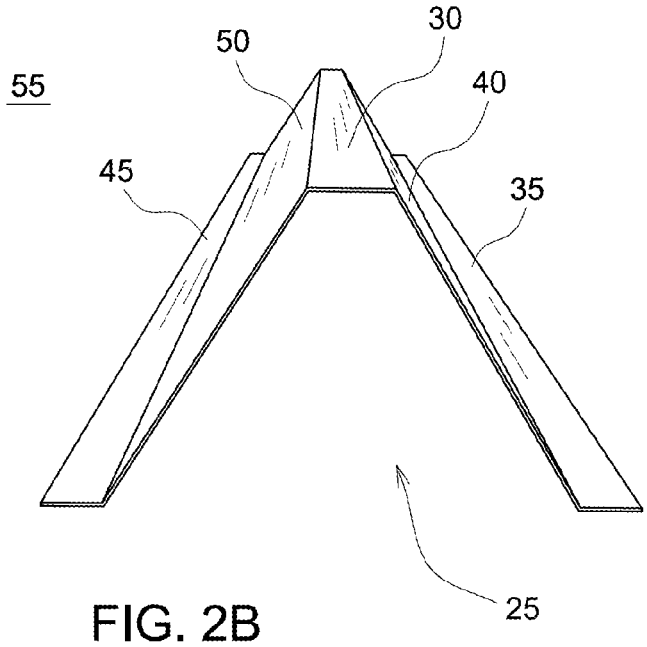

The present inventive concept is generally directed to a portable, modular, and dynamically sized and shaped, above-ground, industrial liquid-containment system, which, for ease of reference, will be hereafter referred to as the "Quick-Pit Containment System".

In an exemplary embodiment, the Quick-Pit Containment System includes a plurality of elongated curbs, each of which has a substantially inverted-V-shaped cross section. In variations, each curb can have a flat top surface, from which two walls extend downwardly at a predetermined angle (typically approximately 30 degrees relative to the normal vector extending down from the top surface). At the bottom of each of the curb walls, is a "foot" surface extending substantially parallel to the ground and to the flat top surface. The plurality of curbs are detachably coupled together to define a perimeter for a liquid-containment area. The floor of the defined containment area and the plurality of curbs is continuously covered by liquid-impermeable sheeting in order to prevent industrial-liquid leakage from the containment area to the outer ground environment.

In a typical embodiment, the curbs are relatively lightweight (as compared to traditional cross-ties, hay bales, and metal culverts), and can be nested/stacked on top of each other to facilitate easy stowage and transport to and from a work site.

In an exemplary application, the Quick-Pit Containment System is comprised of a single-layer of curbs that cause the containment wall to attain a height of about 18-24 inches. However, in other variations, additional "top-layer" curb members can be removably installed on top of the first layer of curbs to attain a greater containment wall height. These "top-layer" curb members are typically constructed similarly to the first-layer curbs; however, the "top-layer" curbs necessarily have a smaller A-frame angle as compared to the first-layer curb members in order to allow the top-layer curbs to be attached near the top part of the walls of the first-layer curb via foot members that are angled to couple substantially flushly with the walls of the first-layer curbs. In a typical variation on this theme, a Quick-Pit Containment System can have a containment wall height of three feet or more.

Terminology

The terms and phrases as indicated in quotes (" ") in this section are intended to have the meaning ascribed to them in this Terminology section applied to them throughout this document, including the claims, unless clearly indicated otherwise in context. Further, as applicable, the stated definitions are to apply, regardless of the word or phrase's case, to the singular and plural variations of the defined word or phrase.

The term "or", as used in this specification and the appended claims, is not meant to be exclusive; rather, the term is inclusive, meaning "either or both".

References in the specification to "one embodiment", "an embodiment", "a preferred embodiment", "an alternative embodiment", "a variation", "one variation", and similar phrases mean that a particular feature, structure, or characteristic described in connection with the embodiment is included in at least an embodiment of the invention. The appearances of the phrase "in one embodiment" and/or "in one variation" in various places in the specification are not necessarily all meant to refer to the same embodiment.

The term "couple" or "coupled", as used in this specification and the appended claims, refers to either an indirect or a direct connection between the identified elements, components, or objects. Often, the manner of the coupling will be related specifically to the manner in which the two coupled elements interact.

The term "removable", "removably coupled", "readily removable", "readily detachable", "detachably coupled", and similar terms, as used in this patent application specification (including the claims and drawings), refer to structures that can be uncoupled from an adjoining structure with relative ease (i.e., non-destructively, and without a complicated or time-consuming process) and that can also be readily reattached or coupled to the previously adjoining structure.

However, the term "fixedly, but detachably, coupled", as used in this patent application specification (including the claims and drawings), is meant to indicate a structurally sound, but not permanent, coupling between components. Such couplings often involve the use of hardware fasteners that must be assembled and disassembled to couple or decouple components, respectively.

Directional and/or relational terms such as, but not limited to, left, right, nadir, apex, top, bottom, vertical, horizontal, back, front, and lateral are relative to each other, are dependent on the specific orientation of an applicable element or article, are used accordingly to aid in the description of the various embodiments in this specification and the appended claims, and are not necessarily intended to be construed as limiting.

As applicable, the terms "about" or "generally", as used herein in the specification and appended claims, and unless otherwise indicated, means a margin of +−20%. Also, as applicable, the term "substantially" as used herein in the specification and appended claims, unless otherwise indicated, means a margin of +−10%. It is to be appreciated that not all uses of the above terms are quantifiable such that the referenced ranges can be applied.

The term, "substantially inverted 'V' channel", and similar terms, as used in this patent application specification (including the appended claims), refers to a rigid structure with two primary angled side walls angled toward each other at the top of the structure such that is the plane of each of the two walls extends such that the planes intersect, an upside-down (inverted) "V" shape is realized when the structure is viewed from the end and through the formed channel. Such a structure does not require that the two primary walls actually intersect, and there can be intervening surfaces between the two walls, such as a relatively narrow, horizontally flat, top surface.

The term, "predetermined angle", and similar terms, as used in this patent application specification (including the appended claims), refers to a user-defined angle for establishing the needed corners of a defined perimeter boundary of an industrial-liquid containment system; for example, a 90° angled corner. In addition, the term "predetermined angle" can also refer to a user-defined angle for the primary walls for curb members, curb-height extender members, and corner curb members. While the Detailed Description provides a few examples on such curb-member-design angles, the angles used to be effective depends on the anticipated duty load for the curb members, including the needed enhanced curb height to be obtained by the installation of curb-height extender members.

The term, "substantially end-to-end" in regard to a plurality of curb members and curb-height extender members, and similar terms, as used in this patent application specification (including the appended claims), is not literally limited to such curb members being placed substantially in-line with respect to each other, and in fact encompasses the situation where the ends of two curb members are brought in some proximity to each other at an angle in order to form a user-defined angle in the perimeter boundary of an industrial-liquid containment system.

First Embodiment

An Industrial-Liquid Containment System Kit

This embodiment is generally directed to an industrial-liquid-containment system kit, from which a customizable in-field industrial-liquid containment system can be erected. Refer to FIGS. 1A-6B, which provide many and various detailed technical disclosures in support of many embodiments and variations of the industrial-liquid-containment system kit. It should be noted that for ease of understanding of the various kit components, the following discussion of the industrial-liquid-containment system kit includes references to various kit components as if they are installed in an in-field application.

In an embodiment, the industrial-liquid-containment system kit has components to create a raised perimeter boundary around a target industrial-liquid vessel 70, with a leakage-containment buffer area 60 constructed from one or more substantially rigid, elongate, curb members 55 that has a cross-sectional shape of an inverted "V" 25, or a cross-sectional shape that approximates an inverted "V" 25. In variations, a curb member 55 has a first declining side 40 and an opposite second declining side 50. In some embodiments, the two sides 40, 50 are each angled at approximately the same amount from the vertical centerline of the curb member 55. Typically, but not necessarily, the overall angle between the two sides 40, 50 is approximately 60°±5°, and often are each angled about 30° from the vertical centerline of the curb member 55, as viewed from the end of the curb member 55. In other variations, a curb member 55 can have a narrow top flat surface 30, as the two sides 40, 50 do not directly intersect. This top flat surface 30 helps to minimize the stress/wear on the liquid-impermeable membrane/sheeting 10 that is later installed over the curb member 55, as opposed to what might be the case if the curb member 55 simply terminated at a pointed arch where the two sides 40, 50 would directly meet.

In many embodiments, the substantially uniform shape of the curb members 55, and the uniform angling of their side walls 40, 50 facilitates the nestable stacking of a plurality of curb members 55, which reduces the storage area required for the components, and which makes transport to a worksite easier.

In still another variation, a curb member 55 can be equipped with a first longitudinally disposed "foot" or flange 35 that is continuously attached to the length of the first wall 40, and similarly, on the opposite side of the curb member 55 is a second longitudinally disposed "foot" or flange 45 that is continuously attached to the length of the second wall 50. Typically, these two flanges 35, 45 are substantially flat and are adapted to help a curb member 55 rest with stability on the ground and minimize the amount that either wall 40, 50 of the curb member 55 can sink into the ground.

In another embodiment, each of the plurality of curb members 55 is substantially comprised of a sheet material selected from a group comprised of aluminum, aluminum alloy, steel, plastic, rubber, wood products, and/or fiberglass.

In a variation, a plurality of curb members 55 are positioned substantially end-to-end, although corners 20 are formed as necessary such that the ends of said curb members 55 used to form a corner 20 are proximal to each other (as opposed to end-to-end), in order to define a perimeter boundary 60 around a target storage container of liquid 70.

Figure 5A:
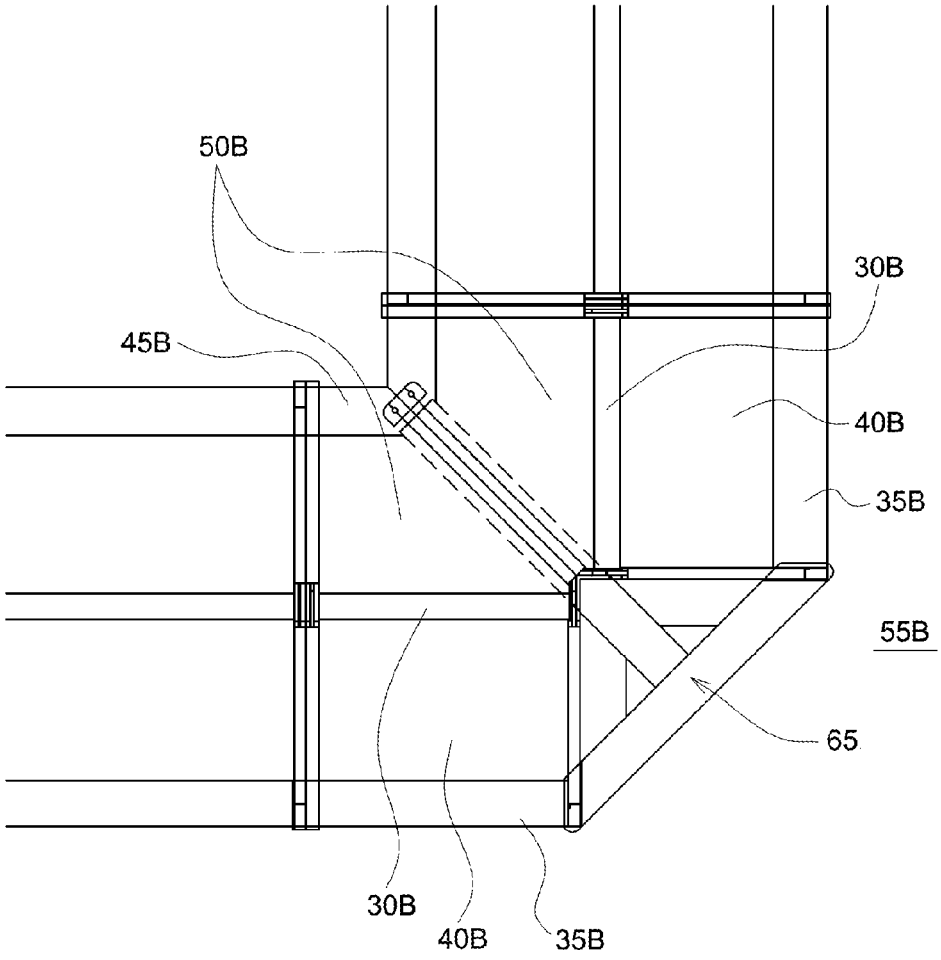
FIGS. 5A-5E depict an alternate embodiment of how a corner can be constructed within the erected perimeter boundary of an industrial-liquid-containment system.
Figure 5B:
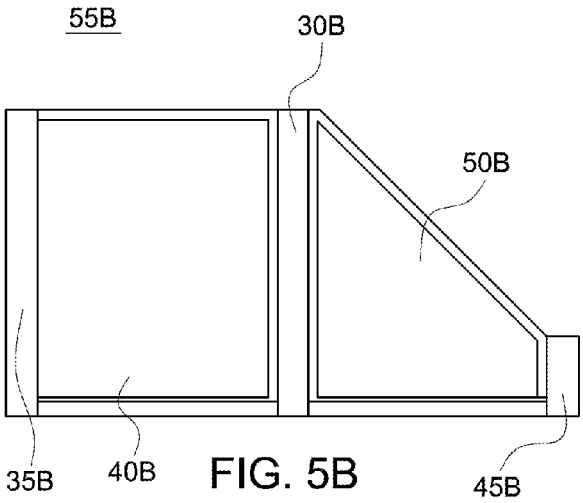
Figure 5C:
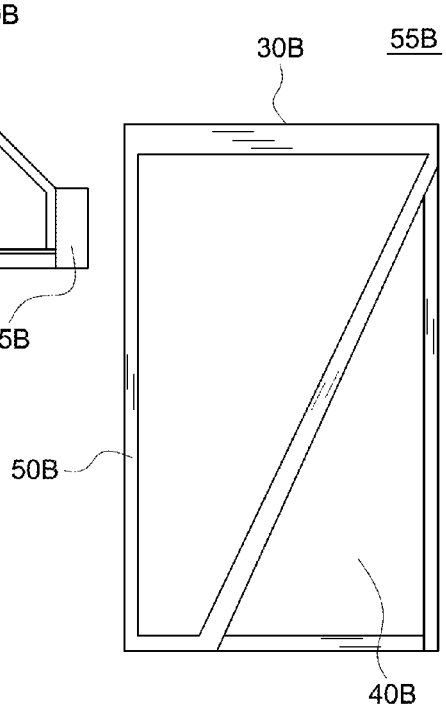
Figure 5D:
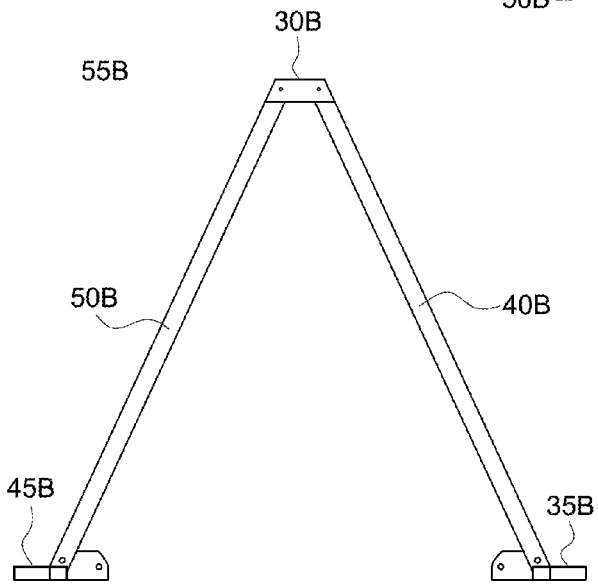
Figure 5E:
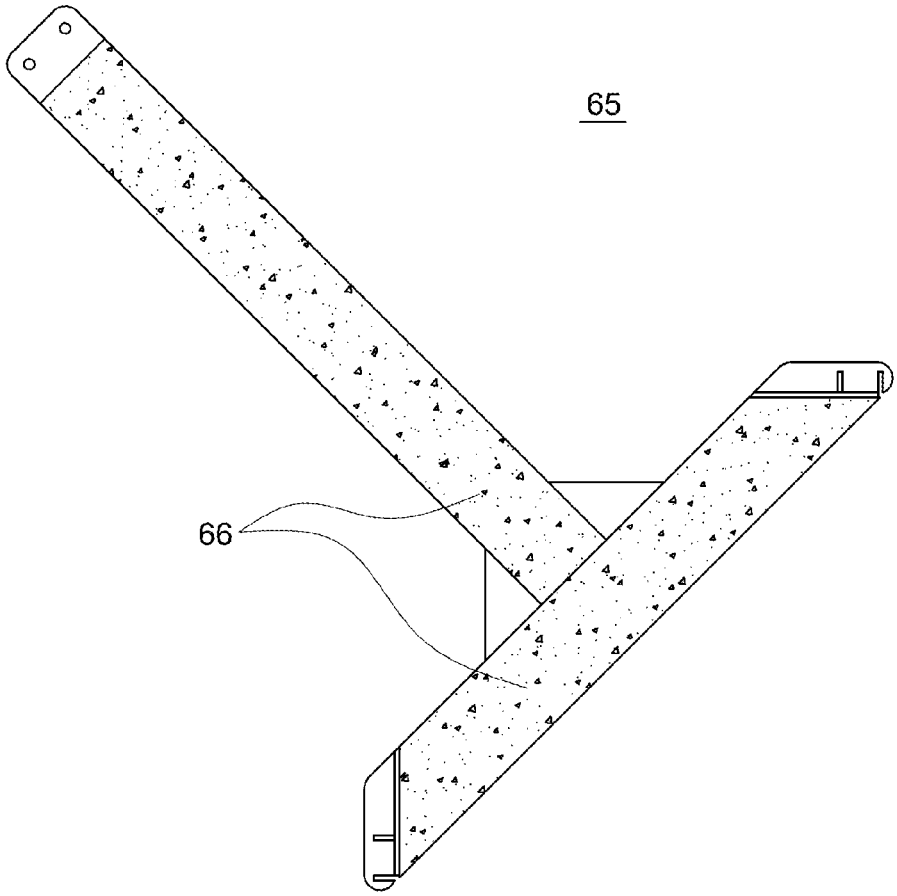

Referring to FIGS. 5A-5C, in another alternative variation on corner construction, a plurality of pairs of mated, substantially rigid, corner curb members 55B are adapted to substantially form a predetermined angle at the point where the corner curb member 55B of each of the mated pairs is substantially buttressed to the other at the predetermined angled mating edges Like the regular curb members 55, corner curb members 55B can be shaped to form a substantially inverted "V" channel when resting on the ground, have sidewalls 40B, 50B, can have stabilizing "feet" (flanges) 35B, 45B, and can have a top flat surface 30B. In addition, in many embodiments, corner curb members 55B are substantially comprised of a sheet material selected from a group comprised of aluminum, aluminum alloy, steel, plastic, rubber, wood products, and/or fiberglass. Similarly, corner curb members 55B can be nestably stacked, which reduces the storage area required for the components, and which makes transport to a worksite easier. In some embodiments, the corner curb members 55B are adapted to be detachably coupled to a ground-level rigid ballast member 65, wherein the ballast member 65 is adapted to hold each of the corner curb members 55B of a mated pair of corner curb members 55B in position at said predetermined angle, depending on the designed shape and size of a perimeter boundary of an industrial-liquid-containment system. On the non-angled end of each corner curb member 55B, the corner curb member 55B is positioned substantially end-to-end with an adjacent said elongated curb member 55 in order to help define a perimeter boundary around a target storage container of liquid. In still more variations, a ballast member 65 can is substantially made of a material selected from a group comprised of aluminum, aluminum alloy, steel, hard plastic, wood products, and/or fiberglass. Moreover, in still another embodiment, each ballast member 65 contains a weighting material 66 to help anchor each ballast member 65 and its associated corner curb members 55B in place on the ground, and each ballast member 65 is weighted with a material 66 selected from a group comprised of concrete, dirt, and/or metal.

In many embodiments, the vertical height of the plurality of curb members 55 and corner curb members 55B can be of any predetermined value; however, in many exemplary variations, the average vertical height of the plurality of curb members 55, 55B is 18-24 inches, as measured orthogonally from the ground to a height corresponding to the apex of curb members 55, 55B.

Figure 3A:
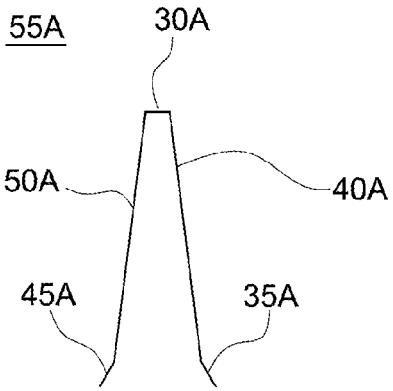
FIGS. 3A-3C depict one embodiment of an elongated, substantially rigid, curb-height extender member (FIG. 3A; 3C) and its relationship with an embodiment of an elongated, substantially rigid, curb member (see FIGS. 2A-2B; 3B) in order to raise the height of the wall of the perimeter boundary of an industrial-liquid-containment system.
Figure 3B:
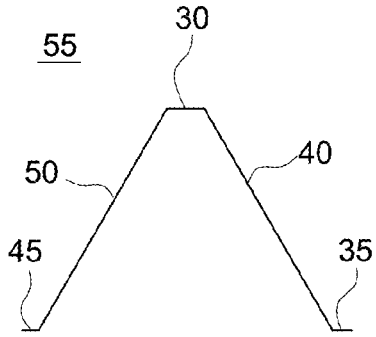
Figure 3C:
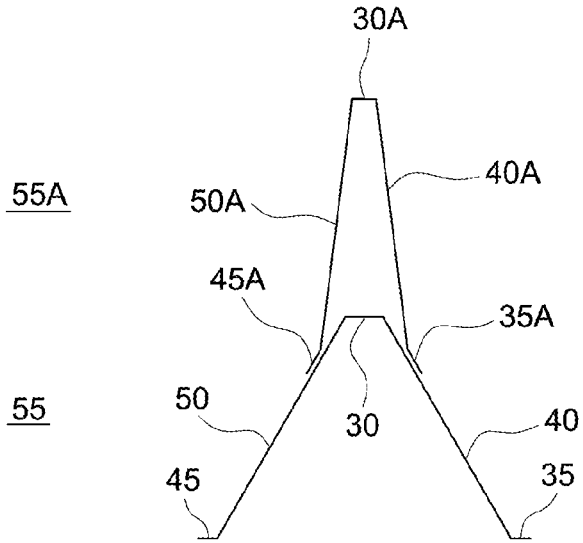
Figure 4:
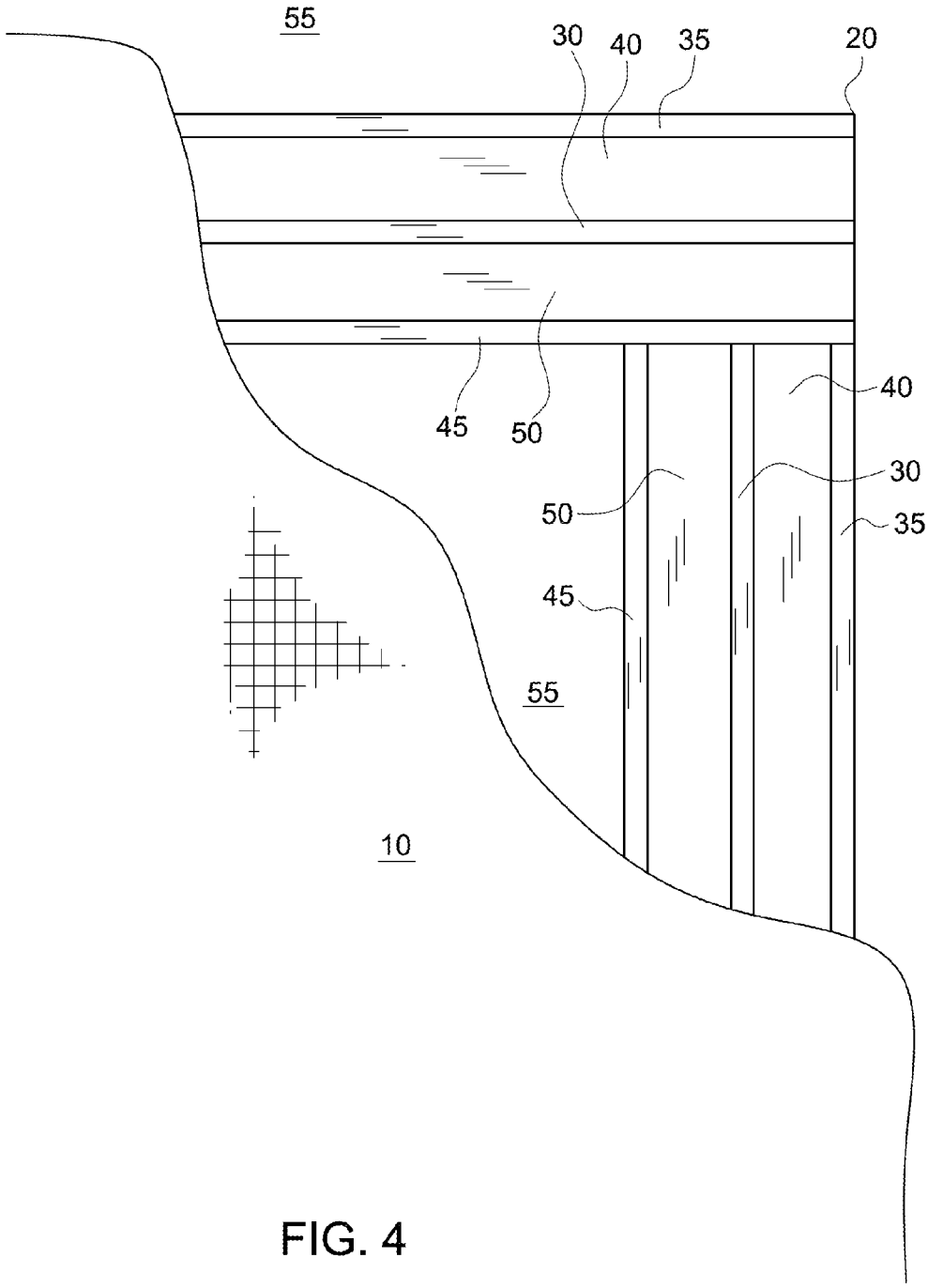
FIG. 4 depicts a top-view of one embodiment of how two typical curb members are oriented to form a corner of the perimeter boundary of an industrial-liquid-containment system, with the liquid-impermeable covering pulled back to display the corner.

However, referring to FIGS. 3A-3C, in still more embodiments, the curb/berm height can be extended by installing a plurality of elongated, substantially rigid, curb-height extender members 55A, wherein each curb-height extender member 55A is substantially comprised of a sheet material selected from a group comprised of aluminum, aluminum alloy, steel, plastic, rubber, wood products, and/or fiberglass. In a variation, each of curb-height extender members 55A is shaped to form a substantially inverted "V" channel when resting on the ground, but at a narrower inverted "V" angle than that of curb members 55. For example, in a typical variation, the two walls 40A, 50A of the substantially inverted "V" shape of each of the plurality of curb-height extender members form an angle of 30°±5°.

In addition, in another embodiment, each curb-height extender member 55A is adapted to be fixedly, but detachably, coupled to one or more curb members 55, 55B in order to raise the effective curb height before the liquid-impermeable sheeting 10 is installed over the defined perimeter boundary. Like in the case of curb members 55 and corner curb members 55B, curb-height extender members 55A are adapted, in an embodiment, to be nestably stacked as necessary to facilitate reduced required storage space, as well as to facilitate easier transport. In many cases, a plurality of curb-height extender members 55A are adapted to be positioned substantially end-to-end, conforming to the perimeter boundary defined by the associated plurality of curb members 55.

In an embodiment, each of the curb-height extender members 55A has a substantially flat flange 35A, 45A extending from and longitudinally along the bottom of each side 40A, 50A of said curb-height extender member, and each flat flange 35A, 45A is adapted to substantially rest on the declined surface of the upper-half region of the substantially inverted "V" shape 25 of a curb member 55.

In other variations, a curb-height extender member 55A can have a narrow top flat surface 30A, as the two sides 40A, 50A do not directly intersect. This top flat surface 30A helps to minimize the stress/wear on the liquid-impermeable membrane/sheeting 10 that is later installed over the curb-height extender member 55A, as opposed to what might be the case if the curb-height extender member 55A simply terminated at a pointed arch where the two sides 40A, 50A would directly meet.

In more embodiments, a curb-height extender member 55A is adapted to be detachably coupled to a curb member 55 and/or curb-corner members 55B using a plurality of fasteners selected from a group comprised of screws, bolts, adhesive tape, hook-and-loop straps, and/or tab-and-slot couplers.

In many embodiments, the vertical height of the plurality of curb members 55, 55B combined with a plurality of curb-height extender members 55A can be of any predetermined value; however, in many exemplary variations, the average vertical height of the combination of the plurality of members 55, 55A, 55B is 36-42 inches, as measured orthogonally from the ground to a height corresponding to the apex of the members 55, 55A, 55B.

In additional variations, the plurality of installed curb-height extender members 55B are further supported by a plurality of buttressing supports, which is adapted to be fixedly, but detachably coupled to the curb-height extenders 55B. Moreover, these buttressing supports can be located on either or both sides of the curb-height extender members 55B.

Figure 6A:
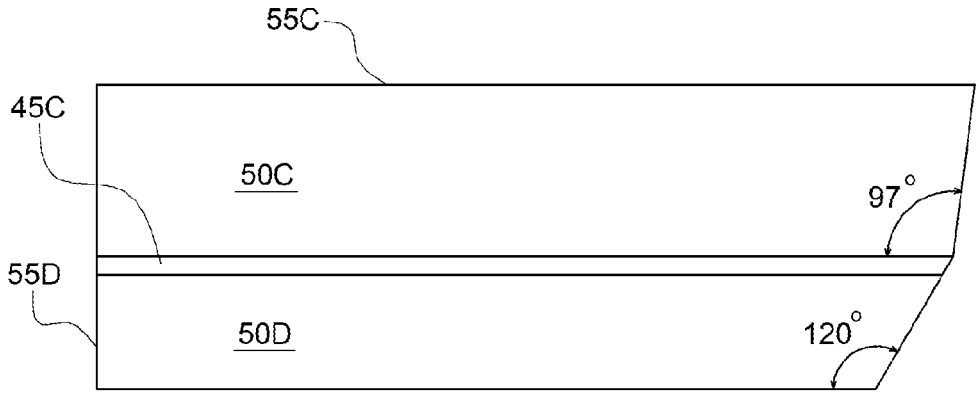
FIGS. 6A-6B depict an alternate embodiment of how a corner can be constructed within the erected perimeter boundary of an industrial-liquid-containment system, to include both pairs of curb members that are modified to mate with each other at predetermined angles to form "clean" corners, and to include pairs of curb-height extender members similarly modified to mate with each other at predetermined angles to form "clean" corners.
Figure 6B:
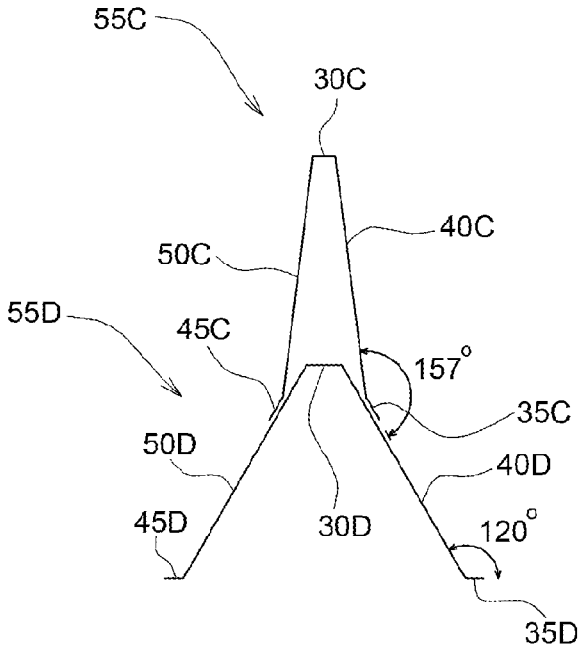

Referring to FIGS. 6A-6B, in yet other embodiments, a pair of curb members 55D can be clipped at appropriate angles of their common walls (either 40D or 50D) in order to facilitate the pair curb members 55D to be brought together to form a "clean" corner. For example, to form a 90° corner with a pair of modified curb members 55D, the mating sidewall 50D of each curb member 55D to form the corner has a 60° section clipped away (relative to the bottom longitudinal surface), leaving a 120° angled edge relative to the bottom stabilizing flange's 45D longitudinal surface. In variations of embodiments where a plurality of curb-height extender members 55A are used, the corners are further defined by attaching modified pair of curb-height extender members 55C on top of the modified corner curb members 55D, wherein the mating sidewall (either 40C or 50C) of the modified curb-height extender members 55C are also clipped at appropriate angles in order to facilitate the pair of curb-height extender members 55C to be brought together to form a "clean" corner. For example, building upon the previous example of forming a 90° corner using a pair of modified curb members 55D with a pair of modified curb-height extender members 55C mounted on top, the mating sidewall 50C of each curb-height extender member 55C to form the corner has a 83° section clipped away (relative to the bottom longitudinal surface), leaving a 97° angled edge relative to the bottom stabilizing flange's 45C longitudinal surface. Of course, one skilled in the art would appreciate that these angles can vary according to either or both of the desired predetermined angle of the corner to be formed and the angles formed by the substantially inverted "V" channels of the curb members 55, 55D and the curb-height extender members 55A, 55C.

In yet other variations, as stated supra, the plurality of curb members 55 and/or corner curb members 55B, and the plurality of curb-height extender members 55A are substantially positioned end-to-end with respect to adjacent members around the defined perimeter boundary. However, in some cases, this positioning can include having associated members 55, 55A, 55B overlap one another. In still more embodiments, the adjacent members 55, 55A, 55B are adapted to be detachably coupled to each other using fasteners selected from a group comprised of screws, bolts, nuts, brackets, swinging pawls and latches, hoop-and-loop strapping, tab-and-slot devices, or any combination of the preceding. It should be noted, however, that in many applications, coupling between the plurality of associated members of the same type 55, 55A, 55B may be unnecessary so long as the members are closely positioned as described supra and the liquid-impermeable sheeting is installed. In such cases, the various curb members 55, 55A, 55B are unlikely to creep along the ground.

In many embodiments, the entire leakage-containment buffer area 60 and the perimeter boundary erected from the plurality of curb members 55 is covered by a continuous layer of liquid-impermeable sheeting 10 disposed over the surface 60 under and around said target storage container of liquid 70, the sheeting 10 extending over all of the defined perimeter boundary of an industrial-liquid-containment system. In other variations, the liquid-impermeable sheeting 10 is substantially comprised of a material selected from a group comprised of chlorosulfonated polyethelene (CSPE) and polypropylene. In some other embodiments, liquid-impermeable sheeting 10 is resistant to damage from ultra-violet rays.

Second Embodiment

A Method of Making a Kit for an Industrial-Liquid Containment System

This embodiment is generally directed to a method of making an industrial-liquid-containment system kit, from which a customizable in-field industrial-liquid containment system can be erected. Refer to FIGS. 1A-5E, which provide many and various detailed technical disclosures in support of many embodiments and variations of the industrial-liquid-containment system kit. It should be noted that for ease of understanding of the various kit components, the following discussion of the industrial-liquid-containment system kit includes references to various kit components as if they are installed in an in-field application.

The method comprises the steps of:

- Providing a plurality of elongated, substantially rigid curb members 55, wherein:
  - each of the curb members 55 is comprised of sheet material,
  - each of the curb members 55 is shaped to form a substantially inverted "V" channel 25 when resting on the ground,
  - the shape of each of the curb members 55 is adapted to facilitate the nestable stacking of one or more curb members 55 in order to make storage and transport easier;
- Positioning said plurality of the curb members 55 substantially end-to-end, forming corners as necessary such that the ends of the curb members 55 used to form a corner are proximal to each other (as opposed to strictly end-to-end), in order to be able to define a perimeter boundary around a target storage container of liquid 70; and
- Providing and positioning a continuous layer of liquid-impermeable sheeting 10 disposed over the surface under and around the target storage container of liquid 70, the sheeting 10 extending over all of said defined perimeter boundary.

This embodiment can be enhanced wherein each of the curb members 55 has a substantially flat flange 35, 45 extending from and longitudinally along the bottom of each side 40, 50 of the curb member 55, and each flat flange 35, 45 is adapted to substantially rest on the surface of the ground.

This embodiment can be enhanced wherein each of the plurality of curb members 55 is adapted to be detachably coupled on each end to an adjacent curb member 55.

This embodiment can be enhanced wherein the liquid-impermeable sheeting 10 is substantially comprised of a material selected from a group comprised of chlorosulfonated polyethelene (CSPE) and polypropylene. In further variations, this embodiment can be enhanced wherein the liquid-impermeable sheeting 10 is resistant to damage from ultraviolet rays.

This embodiment can be enhanced wherein the average vertical height of the plurality of curb members 55 is 18-24 inches, as measured orthogonally from the ground to a height corresponding to the apex of a curb member 55.

This embodiment can be enhanced wherein each of the plurality of curb members 55 is substantially comprised of a material selected from a group comprised of aluminum, aluminum alloy, steel, plastic, rubber, wood products, and/or fiberglass.

This embodiment can be enhanced wherein the two walls 40, 50 of said substantially inverted "V" shape 25 of each of the plurality of curb members 55 form an angle of 60°±5°.

This embodiment can be enhanced by further comprising the step of providing a plurality of elongated, substantially rigid, curb-height extender members 55A, wherein:

Each of the curb-height extender members 55A is comprised of sheet material;

Each of the curb-height extender members 55A is shaped to form a substantially inverted "V" channel 25 when resting on the ground, but at a narrower inverted "V" angle than that of the curb members 55;

Each of the curb-height extender members 55A is adapted to be fixedly, but detachably, coupled to one or more curb members 55 in order to raise the effective curb height before the liquid-impermeable sheeting 10 is installed over the defined perimeter boundary;

The shape of each of the curb-height extender members 55A is adapted to facilitate the nestable stacking of one or more curb-height extender members 55A in order to make storage and transport easier; and The plurality of the curb-height extender members 55A are adapted to be positioned substantially end-to-end conforming to the perimeter boundary defined by the plurality of curb members 55.

This embodiment can be enhanced wherein each of the plurality of curb-height extender members 55A is adapted to be detachably coupled on each end to an adjacent curb-height extender member 55A.

This embodiment can be enhanced wherein each of the curb-height extender members 55A has a substantially flat flange 35A, 45A extending from and longitudinally along the bottom of each side of the curb-height extender member 55A, and each flat flange 35A, 45A is adapted to substantially rest on the declined surface of the upper-half region of the substantially inverted "V" shape of a curb member 55.

This embodiment can be enhanced wherein each of said plurality of curb-height extender members 55A is adapted to be detachably coupled to a curb member 55 using a plurality of fasteners selected from a group comprised of screws, bolts, adhesive tape, hook-and-loop straps, and/or tab-and-slot couplers.

This embodiment can be enhanced wherein the average vertical height of the plurality of curb members 55 with attached curb-height extender members 55A is 36-42 inches, as measured orthogonally from the ground to a height corresponding to the apex of a curb-height extender member 55A.

This embodiment can be enhanced wherein each of the plurality of curb-height extender members 55A is substantially comprised of a material selected from a group comprised of aluminum, aluminum alloy, steel, plastic, rubber, wood products, and/or fiberglass.

This embodiment can be enhanced wherein the two walls 40A, 50A of the substantially inverted "V" shape of each of the plurality of curb-height extender members 55A form an angle of 30°±5°.

This embodiment can be enhanced by further comprising the step of providing a plurality of pairs of mated substantially rigid corner curb members 55B adapted to substantially form a predetermined angle at the point where the corner curb member 55B of each said mated pairs is substantially buttressed to the other at the predetermined angled mating edges, wherein:

Each of the corner curb members 55B is comprised of sheet material;

Each of the corner curb members 55B is shaped to form a substantially inverted "V" channel when resting on the ground;

The shape of each of the corner curb members 55B is adapted to facilitate the nestable stacking of one or more corner curb members 55B in order to make storage and transport easier; and The non-angled end of each of the plurality of the corner curb members 55B is positioned substantially end-to-end with an adjacent elongated curb member 55 in order to help define a perimeter boundary around a target storage container of liquid 70.

This embodiment can be enhanced by further comprising the step of providing plurality of pairs of mated substantially rigid corner curb-height extender members 55C, mounted on top of said pairs of mated substantially rigid corner curb members 55D and adapted to substantially form a predetermined angle at the point where the corner curb-height extender member 55C of each of said mated pairs is substantially buttressed to the other at the predetermined angled mating edges, wherein:

Each of the corner curb-height extender members 55C is comprised of sheet material;

Each of the corner curb-height extender members 55C is shaped to form a substantially inverted "V" channel when resting on the ground, but at a narrower inverted "V" angle than that of the corner curb members 55D;

Each of the corner curb-height extender members 55C is adapted to be fixedly, but detachably, coupled to one or more corner curb members 55D;

The shape of each of the corner curb-height extender members 55C is adapted to facilitate the nestable stacking of one or more corner curb-height extender members 55C in order to make storage and transport easier; and The non-angled end of each of the plurality of corner curb-height extender members 55C is adapted to be positioned substantially end-to-end with an adjacent elongated curb-height extender member 55A in order to help define a perimeter boundary around a target storage container of liquid 70.

This embodiment can be enhanced by further comprising the step of providing a ground-level rigid ballast member 65, to which each of said mated pairs of corner curb members 55B is adapted to be detachably coupled, the ballast member 65 adapted to hold each of the corner curb members 55B of a mated pair of corner curb members 55B in position at a predetermined angle. In variations, the detachable coupling between the ballast member 65 and each corner curb member 55B employs hardware fasteners that can include locking pins, nuts, bolts, screws, studs, and/or washers. In still more variations, fully assembled corners sections 55B, 65 can be prefabricated away from the work site, with the corner curb sections 55B and the associated ballast member 65 fixedly coupled at predetermined angles; however, one disadvantage of this is that such prefabrication of corner sections of a perimeter boundary make nestable stowage and transport of the corner components not possible.

This embodiment can be enhanced wherein each ballast member 65 is substantially made of a material selected from a group comprised of aluminum, aluminum alloy, steel, hard plastic, wood products, and/or fiberglass. In addition, in other variations, each ballast member 65 contains a weighting material 66 to help anchor the ballast member 65 and its associated corner curb members 55B in place on the ground, and each ballast member 65 is weighted with a material 66 selected from a group comprised of concrete, dirt, and/or metal.

Third Embodiment

A Method of Installing an Industrial-Liquid Containment System

This embodiment is generally directed to installing a modular, transportable, and size-and-shape modifiable industrial-liquid-containment system using an industrial-liquid-containment system kit according the First Embodiment, described supra. Refer to FIGS. 1A-6B.

The method comprises the steps of:

- Obtaining a liquid-containment system kit according to the First Embodiment, described supra;
- Identifying the boundaries of the liquid-containment system to establish around a target storage container of liquid 70;
- Installing a continuous layer of liquid-impermeable sheeting 10 on the surface below and around the target storage container of liquid 70;
- Placing the plurality of elongated, substantially rigid curb members 55 to define a perimeter containment boundary around the target storage container of liquid 70, wherein:
  - The plurality of curb members 55 are positioned substantially end-to-end, forming corners as necessary such that the ends of the curb members 55 used to form a corner are proximal to each other (as opposed to strictly end-to-end), in order to define a perimeter boundary around a target storage container of liquid 70; and
- Extending a continuous layer of liquid-impermeable sheeting 10 over all of the defined perimeter boundary.

This embodiment can be enhanced wherein each of the curb members 55 has a substantially flat flange 35, 45 extending from and longitudinally along the bottom of each side 40, 50 of the curb member 55, and each flat flange 35, 45 is adapted to substantially rest on the surface of the ground.

This embodiment can be enhanced wherein each of the plurality of curb members 55 is detachably coupled on each end to an adjacent curb member 55.

This embodiment can be enhanced wherein the liquid-impermeable sheeting 10 is substantially comprised of a material selected from a group comprised of chlorosulfonated polyethelene (CSPE) and polypropylene. In further variations, this embodiment can be enhanced wherein the liquid-impermeable sheeting 10 is resistant to damage from ultraviolet rays.

This embodiment can be enhanced wherein the average vertical height of the plurality of curb members 55 is 18-24 inches, as measured orthogonally from the ground to a height corresponding to the apex of a curb member 55.

This embodiment can be enhanced wherein each of the plurality of curb members 55 is substantially comprised of a material selected from a group comprised of aluminum, aluminum alloy, steel, plastic, rubber, wood products, and/or fiberglass.

This embodiment can be enhanced wherein the two walls 40, 50 of said substantially inverted "V" shape 25 of each of the plurality of curb members 55 form an angle of 60°±5°.

This embodiment can be enhanced by further comprising the steps of:

- Before the step of extending said continuous layer of liquid-impermeable sheeting 10 over all of said defined perimeter boundary, providing a plurality of elongated, substantially rigid, curb-height extender members 55A, wherein:
  - Each of the curb-height extender members 55A is comprised of sheet material,
  - Each of the curb-height extender members 55A is shaped to form a substantially inverted "V" channel 25 when resting on the ground, but at a narrower inverted "V" angle than that of the curb members 55,
  - Each of the curb-height extender members 55A is adapted to be fixedly, but detachably, coupled to one or more curb members 55 in order to raise the effective curb height before the liquid-impermeable sheeting 10 is installed over the defined perimeter boundary,
  - The shape of each of the curb-height extender members 55A is adapted to facilitate the nestable stacking of one or more curb-height extender members 55A in order to make storage and transport easier, and
  - The plurality of the curb-height extender members 55A are positioned substantially end-to-end conforming to the perimeter boundary defined by the plurality of curb members 55;
- Coupling each of the plurality of curb-height extender members 55A to at least one of the curb members 55 and thereby raising the effective curb height to a predetermined height; and
- Extending the continuous layer of liquid-impermeable sheeting 10 over all of the defined perimeter boundary with the curb-height extender members 55A installed.

This embodiment can be enhanced wherein each of the plurality of curb-height extender members 55A is detachably coupled on each end to an adjacent curb-height extender member 55A.

This embodiment can be enhanced wherein each of the curb-height extender members 55A has a substantially flat flange 35A, 45A extending from and longitudinally along the bottom of each side of the curb-height extender member 55A, and each flat flange 35A, 45A is adapted to substantially rest on the declined surface of the upper-half region of the substantially inverted "V" shape of a curb member 55.

This embodiment can be enhanced wherein each of said plurality of curb-height extender members 55A is detachably coupled to a curb member 55 using a plurality of fasteners selected from a group comprised of screws, bolts, adhesive tape, hook-and-loop straps, and/or tab-and-slot couplers.

This embodiment can be enhanced wherein the average vertical height of the plurality of curb members 55 with attached curb-height extender members 55A is 36-42 inches, as measured orthogonally from the ground to a height corresponding to the apex of a curb-height extender member 55A.

This embodiment can be enhanced wherein each of the plurality of curb-height extender members 55A is substantially comprised of a material selected from a group comprised of aluminum, aluminum alloy, steel, plastic, rubber, wood products, and/or fiberglass.

This embodiment can be enhanced wherein the two walls 40A, 50A of the substantially inverted "V" shape of each of the plurality of curb-height extender members 55A form an angle of 30°±5°.

This embodiment can be enhanced by further comprising the step of establishing at least one corner 20 of the defined perimeter boundary by installing a pair of mated substantially rigid corner curb members 55B adapted to substantially form a predetermined angle at the point where each corner curb member 55B of a mated pair is substantially buttressed to the other at the predetermined angled mating edges, wherein:

Each of the corner curb members 55B is comprised of sheet material;

Each of the corner curb members 55B is shaped to form a substantially inverted "V" channel when resting on the ground;

The shape of each of the corner curb members 55B is adapted to facilitate the nestable stacking of one or more corner curb members 55B in order to make storage and transport easier; and The non-angled end of each of the plurality of the corner curb members 55B is positioned substantially end-to-end with an adjacent elongated curb member 55 in order to help define a perimeter boundary around a target storage container of liquid 70.

This embodiment can be enhanced wherein the step of installing a pair of mated substantially rigid corner curb members 55 further comprises installing an associated mated pair of substantially rigid corner curb-height extender members 55C, mounted on top of the pair of mated substantially rigid corner curb members 55D and adapted to substantially form a predetermined angle at the point where the corner curb-height extender member of each of the mated pairs is substantially buttressed to the other at the predetermined angled mating edges, wherein:

Each of the corner curb-height extender members 55C is comprised of sheet material;

Each of the corner curb-height extender members 55C is shaped to form a substantially inverted "V" channel when resting on the ground, but at a narrower inverted "V" angle than that of the corner curb members 55D;

Each of the corner curb-height extender members 55C is adapted to be fixedly, but detachably, coupled to one or more corner curb members 55D;

The shape of each of the corner curb-height extender members 55C is adapted to facilitate the nestable stacking of one or more corner curb-height extender members 55C in order to make storage and transport easier; and The non-angled end of each of the corner curb-height extender members 55C is adapted to be positioned substantially end-to-end with an adjacent elongated curb-height extender member 55A in order to help define a perimeter boundary around a target storage container of liquid 70.

This embodiment can be enhanced by further comprising the step of detachably coupling a mated pair of corner curb members 55B to a ground-level rigid ballast member 65, the ballast member 65 adapted to hold each of the corner curb members 55B of a mated pair of corner curb members 55B in position at a predetermined angle.

This embodiment can be enhanced wherein each ballast member 65 is substantially made of a material selected from a group comprised of aluminum, aluminum alloy, steel, hard plastic, wood products, and/or fiberglass. In addition, in other variations, each ballast member 65 contains a weighting material 66 to help anchor the ballast member 65 and its associated corner curb members 55B in place on the ground, and each ballast member 65 is weighted with a material 66 selected from a group comprised of concrete, dirt, and/or metal.

Fourth Embodiment

A Method of Stowing and Transporting an Industrial-Liquid Containment System Kit This embodiment is generally directed to stowing and transporting an industrial-liquid-containment system kit, from which a customizable in-field industrial-liquid containment system can be erected, according the First Embodiment, described supra. Refer to FIGS. 1A-6B.

The method comprises the steps of:

Nestably stacking the plurality of elongated, substantially rigid curb members 55 into one or more user-manageable stacks of curb members 55;

Rolling or folding the continuous layer of liquid-impermeable sheeting 10 into a user-manageable size; and Transporting the stacks of curb members 55 and liquid-impermeable sheeting 10 to a user-defined worksite or to a user-defined storage facility.

This embodiment can be enhanced by further comprising the steps of:

Nestably stacking said plurality of elongated, substantially rigid, curb-height extender members 55A into one or more user-manageable stacks of curb-height extender members 55A; and Transporting the stacks of curb-height extender members 55A to a user-defined worksite or to a user-defined storage facility.

This embodiment can be enhanced by further comprising the steps of:

Nestably stacking said plurality of substantially rigid, corner curb members 55B into one or more user-manageable stacks of corner curb members 55B; and Transporting the stacks of corner curb members 55B to a user-defined worksite or to a user-defined storage facility.

This embodiment can be enhanced by further comprising the steps of:

Nestably stacking said plurality of substantially rigid, corner curb-height extender members 55C into one or more user-manageable stacks of corner curb-height extender members 55C; and Transporting the stacks of corner curb-height extender members 55C to a user-defined worksite or to a user-defined storage facility.

Fifth Embodiment

An Industrial-Liquid Containment System

This embodiment is generally directed to an industrial-liquid-containment system, comprised of components of the industrial-liquid-containment system kit of the First Embodiment, described supra. Refer to FIGS. 1A-6B, which provide many and various detailed technical disclosures in support of many embodiments and variations of the industrial-liquid-containment system kit.

In an embodiment, the industrial-liquid-containment system comprises:

A target storage container 70 of liquid;

A plurality of elongated, substantially rigid curb members 55, wherein

Each of the curb members 55 is comprised of sheet material,

Each of the curb members 55 is shaped to form a substantially inverted "V" channel when resting on the ground, The shape of each of the curb members 55 is adapted to facilitate the nestable stacking of one or more curb members 55 in order to make storage and transport easier, and The plurality of the curb members 55 are positioned substantially end-to-end, forming corners as necessary such that the ends of the curb members 55 used to form a corner are proximal to each other, in order to define a perimeter boundary around the target storage container 70 of liquid; and A continuous layer of liquid-impermeable sheeting 10 disposed over the surface under and around the target storage container 70 of liquid, the sheeting 10 adapted to be extended over all of the defined perimeter boundary.

This embodiment can be enhanced wherein each of the curb members 55 has a substantially flat flange 35, 45 extending from and longitudinally along the bottom of each side of the curb member 55, and each flat flange 35, 45 is adapted to substantially rest on the surface of the ground.

This embodiment can be enhanced wherein each of the plurality of curb members 55 is detachably coupled on each end to an adjacent curb member 55.

This embodiment can be enhanced wherein the liquid-impermeable sheeting 10 is substantially comprised of a material selected from a group comprised of chlorosulfonated polyethelene (CSPE) and polypropylene. In another variation, the liquid-impermeable sheeting 10 is resistant to damage from ultra-violet rays.

This embodiment can be enhanced wherein the average vertical height of the plurality of curb members 55 is 18-24 inches, as measured orthogonally from the ground to a height corresponding to the apex of a curb member 55.

This embodiment can be enhanced wherein each of the plurality of curb members 55 is substantially comprised of a material selected from a group comprised of aluminum, aluminum alloy, steel, plastic, rubber, wood products, and/or fiberglass.

This embodiment can be enhanced wherein the two walls of the substantially inverted "V" shape 25 of each of the plurality of curb members 55 form an angle of 60°±5°.

This embodiment can be enhanced by further comprising a plurality of elongated, substantially rigid, curb-height extender members 55A, wherein:

Each of the curb-height extender members 55A is comprised of sheet material;

Each of the curb-height extender members 55A is shaped to form a substantially inverted "V" channel when resting on the ground, but at a narrower inverted "V" angle than that of said curb members 55;

Each of said curb-height extender members 55A is fixedly, but detachably, coupled to one or more curb members 55 to a predetermined height;

The shape of each of the curb-height extender members 55A is adapted to facilitate the nestable stacking of one or more of said curb-height extenders; and The plurality of curb-height extender members 55 are positioned substantially end-to-end conforming to the perimeter boundary defined by the plurality of curb members 55.

This embodiment can be enhanced wherein each of the plurality of curb-height extender members 55A is detachably coupled on each end to an adjacent curb-height extender member 55A.

This embodiment can be enhanced wherein each of the curb-height extender members 55A has a substantially flat flange 35A, 45A extending from and longitudinally along the bottom of each side of the curb-height extender member 55A, and each flat flange 35A, 45A is adapted to substantially rest on the declined surface of the upper-half region of the substantially inverted "V" shape 25 of a curb member 55.

This embodiment can be enhanced wherein each of the plurality of curb-height extender members 55A is detachably coupled to a curb member 55 using a plurality of fasteners selected from a group comprised of screws, bolts, adhesive tape, hook-and-loop straps, and/or tab-and-slot couplers.

This embodiment can be enhanced wherein the average vertical height of the plurality of curb members 55 with attached curb-height extender members 55A is 36-42 inches, as measured orthogonally from the ground to a height corresponding to the apex of a curb-height extender member 55A.

This embodiment can be enhanced wherein each of the plurality of curb-height extender members 55A is substantially comprised of a material selected from a group comprised of aluminum, aluminum alloy, steel, plastic, rubber, wood products, and/or fiberglass.

This embodiment can be enhanced wherein the two walls of the substantially inverted "V" shape of each of said plurality of curb-height extender members 55A form an angle of 30°±5°.

This embodiment can be enhanced by further comprising at least one pair of mated substantially rigid corner curb members 55B adapted to substantially form a predetermined angle at the point where each corner curb member 55B of a mated pair is substantially buttressed to its mate at the predetermined angled mating edges, wherein:

Each of the corner curb members 55B is comprised of sheet material;

Each of the corner curb members 55B is shaped to form a substantially inverted "V" channel when resting on the ground;

The shape of each of the corner curb members 55B is adapted to facilitate the nestable stacking of one or more corner curb members 55B in order to make storage and transport easier;

The non-angled end of each of the plurality of the corner curb members 55B is adapted to be positioned substantially end-to-end with an adjacent elongated curb member 55 in order to help define a perimeter boundary around the target storage container 70 of liquid; and The mated pair of corner curb members 55B is detachably coupled to a ground-level rigid ballast member 65, the ballast member 65 adapted to hold each of the corner curb members 55B of the mated pair of corner curb members 55B in position at a predetermined angle.

This embodiment can be enhanced by further comprising at least one pair of mated substantially rigid corner curb-height extender members 55C, mounted on top of the at least one pair of mated substantially rigid corner curb members 55D and adapted to substantially form a predetermined angle at the point where the corner curb-height extender member 55C of said mated pair is substantially buttressed to the other at the predetermined angled mating edges, wherein:

Each of the corner curb-height extender members 55C is comprised of sheet material;

Each of the corner curb-height extender members 55C is shaped to form a substantially inverted "V" channel when resting on the ground, but at a narrower inverted "V" angle than that of the corner curb members 55D;

Each of the corner curb-height extender members 55C is adapted to be fixedly, but detachably, coupled to one or more the corner curb members 55D;

The shape of each of the corner curb-height extender members 55C is adapted to facilitate the nestable stacking of one or more corner curb-height extender members 55C in order to make storage and transport easier; and The non-angled end of each of the corner curb-height extender members 55C is adapted to be positioned substantially end-to-end with an adjacent elongated curb-height extender member 55A in order to help define a perimeter boundary around a target storage container 70 of liquid.

This embodiment can be enhanced wherein the ballast member 65 is substantially made of a material selected from a group comprised of aluminum, aluminum alloy, steel, hard plastic, wood products, and/or fiberglass. In more variations, the ballast member 65 contains a weighting material 66 to help anchor the ballast member 65 and its associated corner curb members 55B in place on the ground; and the ballast member 65 is weighted with a material 66 selected from a group comprised of concrete, dirt, and/or metal.

Alternative Embodiments and Other Variations

The various embodiments and variations thereof described herein and/or illustrated in the accompanying Figures are merely exemplary and are not meant to limit the scope of the inventive disclosure. It should be appreciated that numerous variations of the invention have been contemplated as would be obvious to one of ordinary skill in the art with the benefit of this disclosure.

Hence, those ordinarily skilled in the art will have no difficulty devising a myriad of obvious variations and improvements to the invention, all of which are intended to be encompassed within the scope of the claims which follow.

What is claimed is:

1. A liquid-containment system kit, comprising:

a plurality of elongated, substantially rigid curb members, wherein:

each of said curb members is comprised of sheet material, each of said curb members is shaped to form a substantially inverted "V" channel when resting on the ground, said shape of each of said curb members is adapted to facilitate the nestable stacking of one or more of said curb members in order to make storage and transport easier, and said plurality of said curb members are adapted to be positioned substantially end-to-end, forming corners as necessary such that the ends of said curb members used to form the corners are proximal to each other, in order to be able to define a perimeter boundary around a target storage container of liquid;

a plurality of elongated, substantially rigid, curb-height extender members, wherein:

each of said curb-height extender members is shaped to form a substantially inverted "V" channel when resting on the ground, but at a narrower inverted "V" angle than a substantially inverted "V" angle of said curb members, and each of said curb-height extender members is adapted to be fixedly, but detachably, coupled on top of one or more of said curb members;

a continuous layer of liquid-impermeable sheeting adapted to be disposed over a surface under and around the target storage container of liquid, said sheeting adapted to be extended over all of the defined perimeter boundary.

2. The liquid-containment system kit of claim 1, wherein:

each of said curb members has a substantially flat flange extending from and longitudinally along a bottom of each side of each of said curb members, and each said flat flange is adapted to substantially rest on a surface of the ground.

3. The liquid-containment system of claim 1, wherein each of said plurality of curb members is adapted to be detachably coupled on each end to an adjacent curb member.

4. The liquid-containment system kit of claim 1, wherein said liquid-impermeable sheeting is substantially comprised of a material selected from the group consisting of chlorosulfonated polyethelene (CSPE) and polypropylene.

5. The liquid-containment system kit of claim 1, wherein said liquid-impermeable sheeting is resistant to damage from ultra-violet rays.

6. The liquid-containment system kit of claim 1, wherein an average vertical height of said plurality of curb members is 18-24 inches, as measured orthogonally from the ground to a height corresponding to an apex of one of said plurality of curb members.

7. The liquid-containment system kit of claim 1, wherein each of said plurality of curb members is substantially comprised of a material selected from the group consisting of aluminum, aluminum alloy, steel, plastic, rubber, wood products, and fiberglass.

8. The liquid-containment system kit of claim 1, wherein two walls of said substantially inverted "V" shape of each of said plurality of curb members form an angle of 60°±5°.

9. The liquid-containment system kit of claim 1, wherein:

each of said curb-height extender members is comprised of sheet material;

said shape of each of said curb-height extender members is adapted to facilitate the nestable stacking of one or more of said curb-height extenders; and said plurality of said curb-height extender members are adapted to be positioned substantially end-to-end conforming to the perimeter boundary defined by said plurality of curb members.

10. The liquid-containment system kit of claim 9, wherein each of said plurality of curb-height extender members is adapted to be detachably coupled on each end to an adjacent curb-height extender member.

11. The liquid-containment system kit of claim 9, wherein:

each of said curb-height extender members has a substantially flat flange extending from and longitudinally along a bottom of each side of each of said curb-height extender members, and each said flat flange is adapted to substantially rest on a declined surface of the upper-half region of said substantially inverted "V" shape of one of the curb members.

12. The liquid-containment system kit of claim 9, wherein an average vertical height of said plurality of curb members with attached curb-height extender members is 36-42 inches, as measured orthogonally from the ground to a height corresponding to an apex of one of the curb-height extender members.

13. The liquid-containment system kit of claim 9, wherein each of said plurality of curb-height extender members is substantially comprised of a material selected from the group consisting of aluminum, aluminum alloy, steel, plastic, rubber, wood products, and fiberglass.

14. The liquid-containment system kit of claim 9, wherein two walls of said substantially inverted "V" shape of each of said plurality of curb-height extender members form an angle of 30°±5°.

15. The liquid-containment system kit of claim 1, further comprising a plurality of pairs of mated substantially rigid corner curb members adapted to substantially form a predetermined angle at a point where the corner curb member of each of said mated pairs is substantially buttressed to the other at predetermined angled mating edges, wherein:

each of said corner curb members is comprised of sheet material;

each of said corner curb members is shaped to form a substantially inverted "V" channel when resting on the ground;

said shape of each of said corner curb members is adapted to facilitate the nestable stacking of one or more of said corner curb members in order to make storage and transport easier; and an end of each of said plurality of said corner curb members is adapted to be positioned substantially end-to-end with an adjacent said elongated curb member in order to help define a perimeter boundary around a target storage container of liquid.

16. The liquid-containment system kit of claim 15, further comprising a plurality of pairs of mated substantially rigid corner curb-height extender members, mounted on top of said pairs of mated substantially rigid corner curb members and adapted to substantially form a predetermined angle at a point where the corner curb-height extender member of each of said mated pairs is substantially buttressed to the other at predetermined angled mating edges, wherein:

each of said corner curb-height extender members is comprised of sheet material;

each of said corner curb-height extender members is shaped to form a substantially inverted "V" channel when resting on the ground, but at a narrower inverted "V" angle than a substantially inverted "V" angle of said corner curb members;

each of said corner curb-height extender members is adapted to be fixedly, but detachably, coupled to one or more said corner curb members;

said shape of each of said corner curb-height extender members is adapted to facilitate the nestable stacking of one or more of said corner curb-height extender members in order to make storage and transport easier; and an end of each of said plurality of said corner curb-height extender members is adapted to be positioned substantially end-to-end with an adjacent said elongated curb-height extender member in order to help define a perimeter boundary around a target storage container of liquid.

17. The liquid-containment system kit of claim 15, wherein each of said mated pairs of corner curb members is adapted to be detachably coupled to a ground-level rigid ballast member, said ballast member adapted to hold each of the corner curb members of a mated pair of corner curb members in position at said predetermined angle.

18. The liquid-containment system kit of claim 17, wherein each said ballast member is substantially made of a material selected from the group consisting of aluminum, aluminum alloy, steel, hard plastic, wood products, and fiberglass.

19. The liquid-containment system kit of claim 17, wherein:

each said ballast member contains a weighting material to help anchor each said ballast member and its associated corner curb members in place on the ground; and each said ballast member is weighted with a material selected from the group consisting of concrete, dirt, and metal.

20. A method of installing a liquid-containment system using a liquid-containment system kit according to claim 1, comprising the steps of:

obtaining the liquid-containment system kit according to claim 1;

identifying the perimeter boundary of the liquid-containment system around the target storage container of liquid;

installing said continuous layer of liquid-impermeable sheeting on the surface below and around said target storage container of liquid;

placing said plurality of elongated, substantially rigid curb members to define the perimeter boundary around said target storage container of liquid, wherein:

said plurality of said curb members are positioned substantially end-to-end, forming the corners as necessary such that the ends of each of said curb members used to form the corners are proximal to each other, in order to define the perimeter boundary around the target storage container of liquid; and extending said continuous layer of liquid-impermeable sheeting over all of said defined perimeter boundary.

21. The method of claim 20, wherein:

each of said curb members has a substantially flat flange extending from and longitudinally along a bottom of each side of each of said curb members, and each said flat flange is adapted to substantially rest on a surface of the ground.

22. The method of claim 20, wherein each of said plurality of curb members is detachably coupled on each end to an adjacent curb member.

23. The method of claim 20, wherein said liquid-impermeable sheeting is substantially comprised of a material selected from the group consisting of chlorosulfonated polyethelene (CSPE) and polypropylene.

24. The method of claim 20, wherein said liquid-impermeable sheeting is resistant to damage from ultra-violet rays.

25. The method of claim 20, wherein an average vertical height of said plurality of curb members is 18-24 inches, as measured orthogonally from the ground to a height corresponding to an apex of one of said plurality of curb members.

26. The method of claim 20, wherein each of said plurality of curb members is substantially comprised of a material selected from the group consisting of aluminum, aluminum alloy, steel, plastic, rubber, wood products, and fiberglass.

27. The method of claim 20, wherein two walls of said substantially inverted "V" shape of each of said plurality of curb members form an angle of 60°±5°.

28. The method of claim 20, further comprising the steps of:

before the step of extending said continuous layer of liquid-impermeable sheeting over all of said defined perimeter boundary:

installing the plurality of elongated, substantially rigid, curb-height extender members, wherein:

each of said curb-height extender members is comprised of sheet material;

each of said curb-height extender members is adapted to be fixedly, but detachably, coupled to one or more said curb members in order to raise the effective curb height before said liquid-impermeable sheeting is installed over said defined perimeter boundary, said shape of each of said curb-height extender members is adapted to facilitate the nestable stacking of one or more of said curb-height extender members in order to make storage and transport easier, and said plurality of said curb-height extender members are positioned substantially end-to-end conforming to the perimeter boundary defined by said plurality of curb members; and coupling each of said plurality of curb-height extender members to at least one of said curb members and thereby raising the effective curb height to a predetermined height.

29. The method of claim 28, wherein each of said plurality of curb-height extender members is detachably coupled on each end to an adjacent curb-height extender member.

30. The method of claim 28, wherein:

each of said curb-height extender members has a substantially flat flange extending from and longitudinally along a bottom of each side of each of said curb-height extender members, and each said flat flange is adapted to substantially rest on a declined surface of the upper-half region of said substantially inverted "V" shape of one of the curb members.

31. The method of claim 28, wherein an average vertical height of said plurality of curb members with attached curb-height extender members is 36-42 inches, as measured orthogonally from the ground to a height corresponding to an apex of one of the curb-height extender members.

32. The method of claim 28, wherein each of said plurality of curb-height extender members is substantially comprised of a material selected from the group consisting of aluminum, aluminum alloy, steel, plastic, rubber, wood products, and fiberglass.

33. The method of claim 28, wherein two walls of said substantially inverted "V" shape of each of said plurality of curb-height extender members form an angle of 30°±5°.

34. The method of claim 20, further comprising the step of establishing at least one corner of said defined perimeter boundary by installing a pair of mated substantially rigid corner curb members adapted to substantially form a predetermined angle at a point where each corner curb member of said mated pair is substantially buttressed to the other at predetermined angled mating edges, wherein:

each of said corner curb members is comprised of sheet material;

each of said corner curb members is shaped to form a substantially inverted "V" channel when resting on the ground;

said shape of each of said corner curb members is adapted to facilitate the nestable stacking of one or more of said corner curb members in order to make storage and transport easier;

said mated pair of corner curb members is detachably coupled to a ground-level rigid ballast member, said ballast member adapted to hold each of the corner curb members of said mated pair of corner curb members in position at said predetermined angle; and an end of each of said corner curb members is positioned substantially end-to-end with an adjacent said elongated curb member in order to help define said perimeter boundary around said target storage container of liquid.

35. The method of claim 34, wherein said step of installing the pair of mated substantially rigid corner curb members further comprises installing an associated mated pair of substantially rigid corner curb-height extender members, mounted on top of said pair of mated substantially rigid corner curb members and adapted to substantially form a predetermined angle at a point where the corner curb-height extender member of each of said mated pairs is substantially buttressed to the other at predetermined angled mating edges, wherein:

each of said corner curb-height extender members is comprised of sheet material;

each of said corner curb-height extender members is shaped to form a substantially inverted "V" channel when resting on the ground, but at a narrower inverted "V" angle than a substantially inverted "V" angle of said corner curb members;

each of said corner curb-height extender members is adapted to be fixedly, but detachably, coupled to one or more said corner curb members;

said shape of each of said corner curb-height extender members is adapted to facilitate the nestable stacking of one or more of said corner curb-height extender members in order to make storage and transport easier; and an end of each of said corner curb-height extender members is adapted to be positioned substantially end-to-end with an adjacent said elongated curb-height extender member in order to help define the perimeter boundary around the target storage container of liquid.

36. The method of claim 34, further comprising the step of detachably coupling the mated pair of corner curb members to a ground-level rigid ballast member, said ballast member adapted to hold each of the corner curb members of the mated pair of corner curb members in position at the predetermined angle.

37. The method of claim 36, wherein said ballast member is substantially made of a material selected from the group consisting of aluminum, aluminum alloy, steel, hard plastic, wood products, and fiberglass.

38. The method of claim 36, wherein:

said ballast member contains a weighting material to help anchor said ballast member and the mated pair of corner curb members in place on the ground; and said ballast member is weighted with a material selected from the group consisting of concrete, dirt, and metal.

39. A method of stowing and transporting a liquid-containment system kit according to claim 1, comprising the steps of:

nestably stacking said plurality of elongated, substantially rigid curb members into one or more user-manageable stacks of curb members;

rolling or folding said continuous layer of liquid-impermeable sheeting into a user-manageable size; and transporting said stacks of curb members and liquid-impermeable sheeting to a user-defined worksite or to a user-defined storage facility.

40. The method of claim 39, wherein said liquid-containment system kit further comprises the limitations of claim 9, further comprising the steps of:

nestably stacking said plurality of elongated, substantially rigid, curb-height extender members into one or more user-manageable stacks of curb-height extender members; and transporting said stacks of curb-height extender members to a user-defined worksite or to a user-defined storage facility.

41. The method of claim 39, wherein said liquid-containment system kit further comprises the limitations of claim 15, further comprising the steps of:

nestably stacking said plurality of corner curb members into one or more user-manageable stacks of corner curb members; and transporting said stacks of corner curb members to a user-defined worksite or to a user-defined storage facility.

42. The method of claim 39, wherein said liquid-containment system kit further comprises the limitations of claim 16, further comprising the steps of:

nestably stacking said plurality of corner curb-height extender members into one or more user-manageable stacks of corner curb-height extender members; and transporting said stacks of corner curb-height extender members to a user-defined worksite or to a user-defined storage facility.

43. A liquid-containment system, comprising:

a target storage container of liquid;

a plurality of elongated, substantially rigid curb members, wherein:

each of said curb members is comprised of sheet material, each of said curb members is shaped to form a substantially inverted "V" channel when resting on the ground, said shape of each of said curb members is adapted to facilitate the nestable stacking of one or more of said curb members in order to make storage and transport easier, and said plurality of said curb members are positioned substantially end-to-end, forming corners as necessary such that the ends of said curb members used to form a corner are proximal to each other, in order to define a perimeter boundary around said target storage container of liquid;

a plurality of elongated, substantially rigid, curb-height extender members, wherein:

each of said curb-height extender members is shaped to form a substantially inverted "V" channel when resting on the ground, but at a narrower inverted "V" angle than that a substantially inverted "V" angle of said curb members, and each of said curb-height extender members is adapted to be fixedly, but detachably, coupled on top of one or more of said curb members to a predetermined height;

a continuous layer of liquid-impermeable sheeting disposed over a surface under and around said target storage container of liquid, said sheeting adapted to be extended over all of said defined perimeter boundary.

44. The liquid-containment system of claim 43, wherein:

each of said curb members has a substantially flat flange extending from and longitudinally along a bottom of each side of each of said curb members, and each said flat flange is adapted to substantially rest on a surface of the ground.

45. The liquid-containment system of claim 43, wherein each of said plurality of curb members is detachably coupled on each end to an adjacent curb member.

46. The liquid-containment system of claim 43, wherein said liquid-impermeable sheeting is substantially comprised of a material selected from the group consisting of chlorosulfonated polyethelene (CSPE) and polypropylene.

47. The liquid-containment system of claim 43, wherein said liquid-impermeable sheeting is resistant to damage from ultra-violet rays.

48. The liquid-containment system of claim 43, wherein an average vertical height of said plurality of curb members is 18-24 inches, as measured orthogonally from the ground to a height corresponding to an apex of one of said plurality of curb members.

49. The liquid-containment system of claim 43, wherein each of said plurality of curb members is substantially comprised of a material selected from the group consisting of aluminum, aluminum alloy, steel, plastic, rubber, wood products, and fiberglass.

50. The liquid-containment system of claim 43, wherein two walls of said substantially inverted "V" shape of each of said plurality of curb members form an angle of 60°±5°.

51. The liquid-containment system of claim 43, wherein:

each of said curb-height extender members is comprised of sheet material;

said shape of each of said curb-height extender members is adapted to facilitate the nestable stacking of one or more of said curb-height extenders; and said plurality of said curb-height extender members are positioned substantially end-to-end conforming to the perimeter boundary defined by said plurality of curb members.

52. The liquid-containment system of claim 51, wherein each of said plurality of curb-height extender members is detachably coupled on each end to an adjacent curb-height extender member.

53. The liquid-containment system of claim 51, wherein:

each of said curb-height extender members has a substantially flat flange extending from and longitudinally along a bottom of each side of each of said curb-height extender members, and each said flat flange is adapted to substantially rest on a declined surface of an upper-half region of said substantially inverted "V" shape of one of the curb members.

54. The liquid-containment system of claim 51, wherein a average vertical height of said plurality of curb members with attached curb-height extender members is 36-42 inches, as measured orthogonally from the ground to a height corresponding to an apex of one of the curb-height extender members.

55. The liquid-containment system of claim 51, wherein each of said plurality of curb-height extender members is substantially comprised of a material selected from the group consisting of aluminum, aluminum alloy, steel, plastic, rubber, wood products, and fiberglass.

56. The liquid-containment system of claim 51, wherein two walls of said substantially inverted "V" shape of each of said plurality of curb-height extender members form an angle of 30°±5°.

57. The liquid-containment system of claim 43, further comprising at least one pair of mated substantially rigid corner curb members adapted to substantially form a predetermined angle at a point where each corner curb member of said mated pair is substantially buttressed at predetermined angled mating edges, wherein:

each of said corner curb members is comprised of sheet material;

each of said corner curb members is shaped to form a substantially inverted "V" channel when resting on the ground;

said shape of each of said corner curb members is adapted to facilitate the nestable stacking of one or more of said corner curb members in order to make storage and transport easier;

a non-angled end of each of said plurality of said corner curb members is adapted to be positioned substantially end-to-end with an adjacent said elongated curb member in order to help define the perimeter boundary around the target storage container of liquid; and said mated pair of corner curb members is detachably coupled to a ground-level rigid ballast member, said ballast member adapted to hold each of the corner curb members of said mated pair of corner curb members in position at said predetermined angle.

58. The liquid-containment system of claim 57, further comprising at least one pair of mated substantially rigid corner curb-height extender members, mounted on top of said at least one pair of mated substantially rigid corner curb members and adapted to substantially form a predetermined angle at a point where the corner curb-height extender member of said mated pair is substantially buttressed to the other at predetermined angled mating edges, wherein:

each of said corner curb-height extender members is comprised of sheet material;

each of said corner curb-height extender members is shaped to form a substantially inverted "V" channel when resting on the ground, but at a narrower inverted "V" angle than a substantially inverted "V" angle of said corner curb members;

each of said corner curb-height extender members is adapted to be fixedly, but detachably, coupled to one or more said corner curb members;

said shape of each of said corner curb-height extender members is adapted to facilitate the nestable stacking of one or more of said corner curb-height extender members in order to make storage and transport easier; and the non-angled end of each of said corner curb-height extender members is adapted to be positioned substantially end-to-end with an adjacent said elongated curb-height extender member in order to help define a perimeter boundary around a target storage container of liquid.

59. The liquid-containment system of claim 57, wherein said ballast member is substantially made of a material selected from the group consisting of aluminum, aluminum alloy, steel, hard plastic, wood products, and fiberglass.

60. The liquid-containment system of claim 59, wherein:

said ballast member contains a weighting material to help anchor said ballast member and the mated pair of corner curb members in place on the ground; and said ballast member is weighted with a material selected from the group consisting of concrete, dirt, and metal.

61. A liquid-containment system kit, comprising:

a plurality of elongated, substantially rigid curb members, wherein:

each of said curb members is comprised of sheet material;

each of said curb members is shaped to form a substantially inverted "V" channel when resting on the ground;

said shape of each of said curb members is adapted to facilitate the nestable stacking of one or more of said curb members in order to make storage and transport easier; and said plurality of said curb members are adapted to be positioned substantially end-to-end, forming corners as necessary such that the ends of said curb members used to form the corners are proximal to each other, in order to be able to define a perimeter boundary around a target storage container of liquid;

a continuous layer of liquid-impermeable sheeting adapted to be disposed over a surface under and around the target storage container of liquid, said sheeting adapted to be extended over all of the defined perimeter boundary;

a plurality of pairs of mated substantially rigid corner curb members adapted to substantially form a predetermined angle at a point where the corner curb member of each of said mated pairs is substantially buttressed to the other at predetermined angled mating edges; and a plurality of pairs of mated substantially rigid corner curb-height extender members, mounted on top of said pairs of mated substantially rigid corner curb members and adapted to substantially form a predetermined angle at a point where the corner curb-height extender member of each of said mated pairs is substantially buttressed to the other at the predetermined angled mating edges, wherein:

each of said corner curb-height extender members is comprised of sheet material;

each of said corner curb-height extender members is shaped to form a substantially inverted "V" channel when resting on the ground, but at a narrower inverted "V" angle than a substantially inverted "V" angle of said corner curb members;

each of said corner curb-height extender members is adapted to be fixedly, but detachably, coupled to one or more of the corner curb members;

said shape of each of said corner curb-height extender members is adapted to facilitate the nestable stacking of one or more of said corner curb-height extender members in order to make storage and transport easier; and an end of each of said plurality of said corner curb-height extender members is adapted to be positioned substantially end-to-end with an adjacent said elongated curb-height extender member in order to help define a perimeter boundary around a target storage container of liquid.

* * * * *